United States Patent [19]

Van Noy

[11] Patent Number: 4,608,780

[45] Date of Patent: Sep. 2, 1986

[54] SPRAY CHANNELING DOOR SEAL

[76] Inventor: William J. Van Noy, 16016 N. 33rd Ave., Phoenix, Ariz. 85023

[21] Appl. No.: 623,392

[22] Filed: Jun. 22, 1984

[51] Int. Cl.[4] ..... E05D 7/00

[52] U.S. Cl. ..... 49/400; 49/402; 49/483; 134/186

[58] Field of Search ..... 49/400, 401, 402, 483, 49/383; 220/337; 134/186, 200; 4/607, 610, 557, 556

[56] References Cited

U.S. PATENT DOCUMENTS 233,277 10/1880 Pratt ..... 49/400

3,437,735 4/1969 Schaller, Jr. ..... 49/401 X 3,663,990 5/1972 Shane ..... 220/337

FOREIGN PATENT DOCUMENTS 493377 10/1938 United Kingdom ..... 49/400

*Primary Examiner*—Philip C. Kannan

*Attorney, Agent, or Firm*—Robert A. Hirschfeld; James F. Duffy

[57] ABSTRACT

An improved door seal incorporates a peripheral maze and peripheral channel forming an elongated flow path between spray-impinging and non-spray-impinging faces of the door, and lateral diversion and drain paths.

14 Claims, 8 Drawing Figures

SPRAY CHANNELING DOOR SEAL

BACKGROUND

1. Field of the Invention

This invention relates generally to door seals and more specifically to door seals which inhibit spray impinging upon a door face from passage to an environment external of said door/face.

2. Prior Art

In the past, access doors communicating between a spray-impinging environment and an external, non-spray impinging environment relied either upon compressible gasket seals or upon intimate contact between door periphery and portal periphery to reduce or inhibit the passage of spray or spray residue to the non-spray-impinging external environment.

The use of compressible gasket seals or intimate contact generally required door latches, closures, or other means for inducing compression or seal intimacy. Where the plane of the closed door is of, horizontal, or nearly horizontal, the drainage locus of spray residue is indeterminate. Where the plane of the closed door is vertical or nearly vertical, spray residue tends to collect at the lower edge or edges of the door-portal interface, and to place greater stress or likelihood of leakage upon the corresponding lower portions of compressible gasket or intimate contact seals.

Certain non-planar gasket or intimate-contact seals imposed friction upon the opening or closing of the door, by virtue of sliding engagement. While prior-art door seals having non-planar interfaces between door and portal peripheries provided lengthened communication paths between spraying-impinging and non-spray-impinging external environments, compared to those having planar interfaces, spray or spray residue could collect in said interfaces and eventually reach the non-spray-impinging environment.

A need existed for a door seal resistant to spray or spray-residue communication from the impinging-spray environment to the non-impinging-spray, external environment which did not rely upon compressible gaskets or intimate interface contact, which provide a lengthened path between said environments less likely to be traversed by spray or spray-residue, without imposing friction in door opening or closure, and having an efficient drainage path for dispositon of spray or spray-residue. In horizontally disposed doors, a need existed for a determinate drainage locus. In vertically disposed doors, a need existed for drainage and diversion of spray or spray-residue away from the lower edge or edges of the door-portal interface, so as to reduce or eliminate stress or leakage at said lower edges.

It is an object of this invention to provide an improved door seal.

It is further object of this invention to provide a door seal having lengthened path between spray-impinging and non-spray-impinging environments without imposing friction in door opening or closure.

Another object of this invention is to provide an efficient drainage path for disposition of spray or spray residue.

Still another object of this invention is to provide a determinate drainage locus for horizontally disposed doors.

It is also an object of this invention to provide, for vertically disposed doors, drainage or diversion of spray or spray-residue, so as to reduce or eliminate stress or leakage at lower edges of the door seal.

SUMMARY OF THE INVENTION

In accordance with one embodiment of this invention, a spray channeling door seal comprises a fixed channel around the periphery of an access opening or door portal, presenting to the direction from which spray impinges a deflecting surface, and to the direction from which the door is openable, a peripheral cavity. A door, which may be hinged at one edge or entirely removable, provides at its periphery a maze which releasably fits within the peripheral cavity when the door is closed, and which in combination with the peripheral cavity forms an elongated path through which impinging spray or liquid residue is less likely to leak than through a path merely equal to the thickness of the door seal.

The peripheral cavity and peripheral maze form lateral drainage paths for the gravitational flow of impinging spray or liquid residue perpendicular to the direction by which door leakage would occur, for drainage around the periphery to a drain or drains through which said impinging spray or liquid residue is diverted to a reservoir or the like, and away from the non-spray-impinging face of the door seal.

In application to a door which, when closed, is vertical or non-horizontal, drains are disclosed which are located along the lowest elevation portion of the peripheral cavity, at intersections with upwardly extending portions of the cavity, to receive and drain impinging spray or liquid residue descending from higher elevations of the peripheral cavity. A lip is also disclosed which diverts impinging spray or liquid residue flowing down non-peripheral surfaces of the spray-impinging face of the door, away from the spray channeling door seal.

For doors which, when closed, are horizontal or nearly horizontal, peripheral cavity and a peripheral maze are disclosed which are canted, for establishment of a lowest drain surface to which impinging spray or liquid residue flows by gravity, despite the horizontal or nearly horizontal disposition of the closed door. A plurality of lips interior to the periphery of the door seal are disclosed for horizontal or nearly horizontal doors which divert away from the door seal impinging spray or liquid residue flowing upon surfaces of the spray-impinging face of the door other than the door seal.

DETAILS OF THE INVENTION

Figure 1:
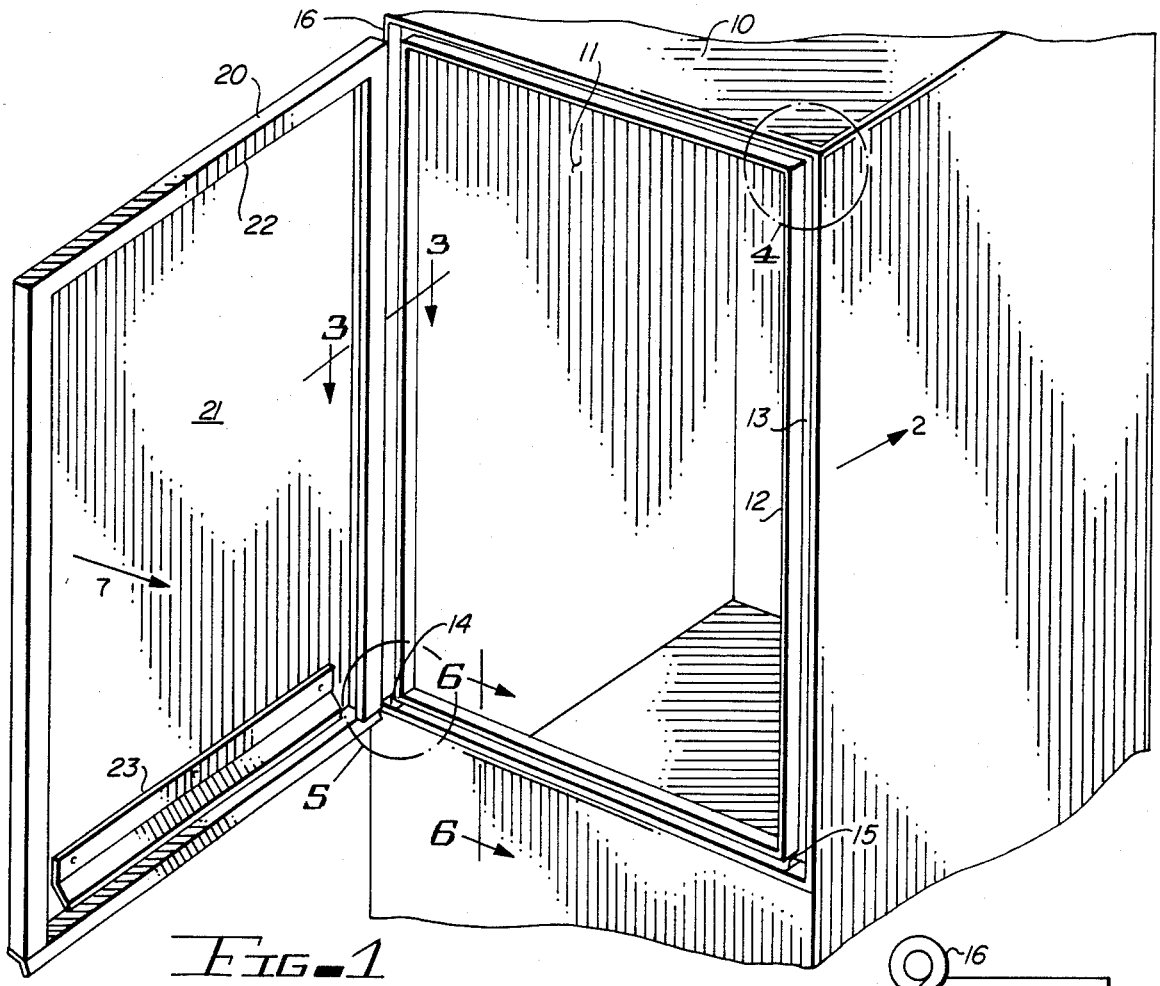
FIG. 1 is a perspective view of a cabinet within which spray is dispersed, showing a peripheral channel around an access portal, and a corresponding protruding maze around the periphery of an open, hinged, vertical door, upon which a deflection lip is shown. At the lower corners of the peripheral channel, drain holes are shown.

For the purpose of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIG. 1, a perspective view shows a cabinet (e.g. an automotive parts spray washer) generally referred to as reference number 10, within which spray is dispersed, and to which access is gained through portal 11. The periphery of portal 11 is encompassed by peripheral channel 12, containing peripheral cavity 13, and drain holes 14, 15. Door 20 is attached to cabinet 10 by hinge 16 (not visible). Peripheral maze 22 protrudes toward cabinet 10 in direction 7 from spray-impinging door face 21. When door 20 is closed, direction 7 is identical to direction 2. Lip 23 directs impinging spray or spray-residue, which by gravity descends face 21, away from the lower portion of the door seal comprised of peripheral channel 12 and peripheral maze 22, when door 20 is closed. Gravity acts in direction 3 (FIG. 2).

Figure 2:
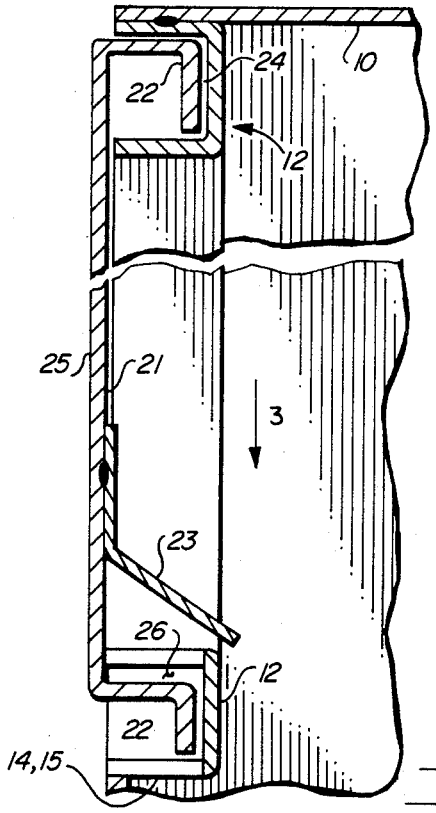
FIG. 2 is a side cross-sectional elevation of the door in closed position, showing the elongated path of flow from spray-impinging face to non-spray-impinging face of the door, by virtue of the peripheral maze fitting within the peripheral channel.

Referring to FIG. 2, a side cross-sectional view shows door 20 in closed position, with peripheral maze 22 within peripheral channel 12 so as to form elongated path 24 between the interior and the exterior of cabinet 10, and between spray-impinging face 21 and the non-spray-impinging external face 25 of door 20. Impinging spray or spray-residue will be restrained by fluid flow characteristics from flowing through constricted, elongated path 24 to the outside of cabinet 10. Fluid will flow laterally along peripheral paths designated 26 (FIGS. 2 and 3) to ultimately drain through drain holes 14, 15 (FIGS. 1 and 6) to a reservoir at the bottom of the interior of cabiner 10. Lip 23 is disposed above the lower portion of peripheral channel 12, so as to divert impinging spray or liquid-residue flowing by gravity down face 21 of door 20 beyond peripheral channel 12, thereby reducing the amount of liquid which would otherwise flow through peripheral path 26, (FIG. 6) and thereafter drain through drain holes 14, 15.

Figure 3:
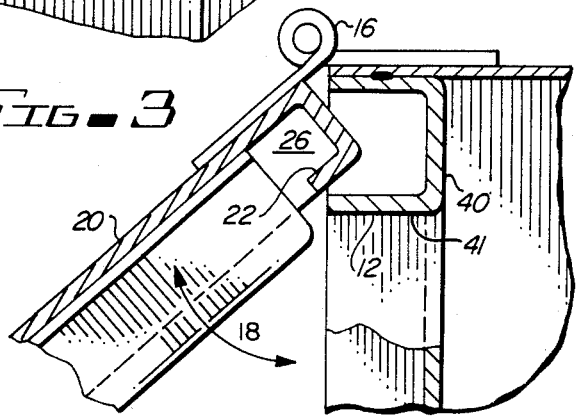
FIG. 3 is a top cross-sectional view showing partial closure of the door and partial engagement of the peripheral maze and peripheral channel.

FIG. 3 illustrates, in a top cross-sectional view, partial closure of door 20, with partial engagement of peripheral maze 22 into peripheral channel 12, as door 20 is closed through arc 18. Surfaces 40 and 41 act as deflectors to deflect impinging spray away from peripherial path 26.

Figure 4:
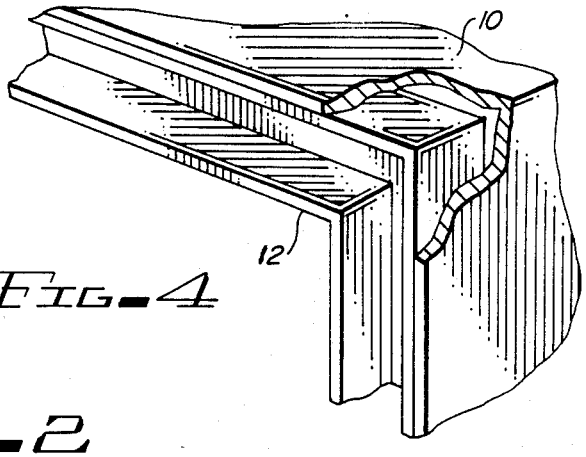
FIG. 4 is a cutaway perspective view of a corner of the cabinet of FIG. 1.

A cutaway perspective view shows in FIG. 4 the fitting of peripheral channel 12 into cabinet 10.

Figure 5:
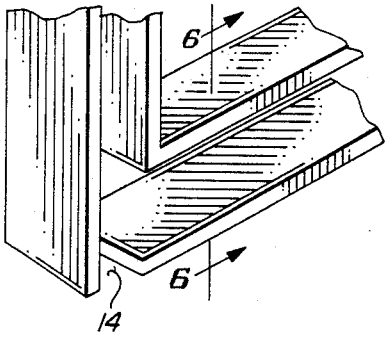
FIG. 5 is a cutaway perspective view of the lower horizontal portion of the peripheral channel, showing a drain opening.

Drain hole 14 is more clearly visible in the partially magnified view of FIG. 5, showing hole 14's position below the vertical upwardly extending portion of peripheral channel 12.

Figure 6:
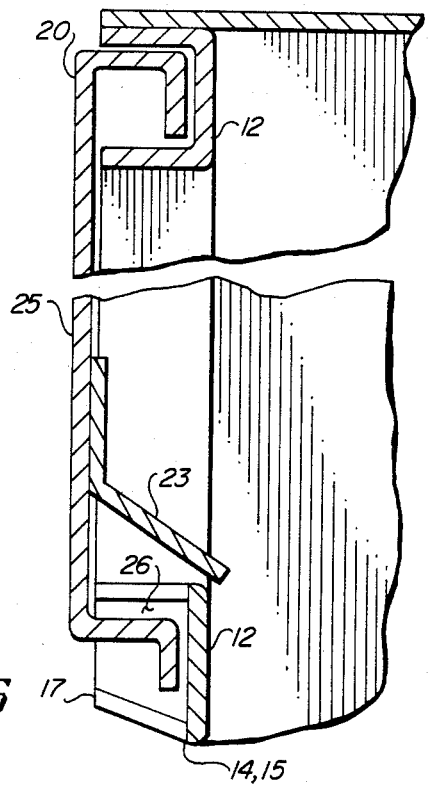
FIG. 6 is an alternative side cross-sectional elevation similar to FIG. 2, showing a canted version of the lower edge of the lower horizontal portion of the peripheral channel for improved drainage.

An alternative embodiment of the lower edge 17 of the lower horizontal portion of the peripheral channel 12, illustrated in FIG. 6, is canted downward and away from face 25 of door 20, so that any residual liquid flows by gravity toward drain holes 14, 15.

Figure 8:
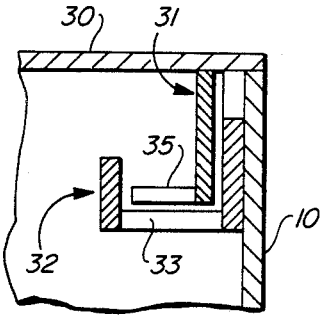
FIG. 8 is a cross sectional detail of the section designated 8—8 of FIG. 7 with top-mounted door in place.
Figure 7:
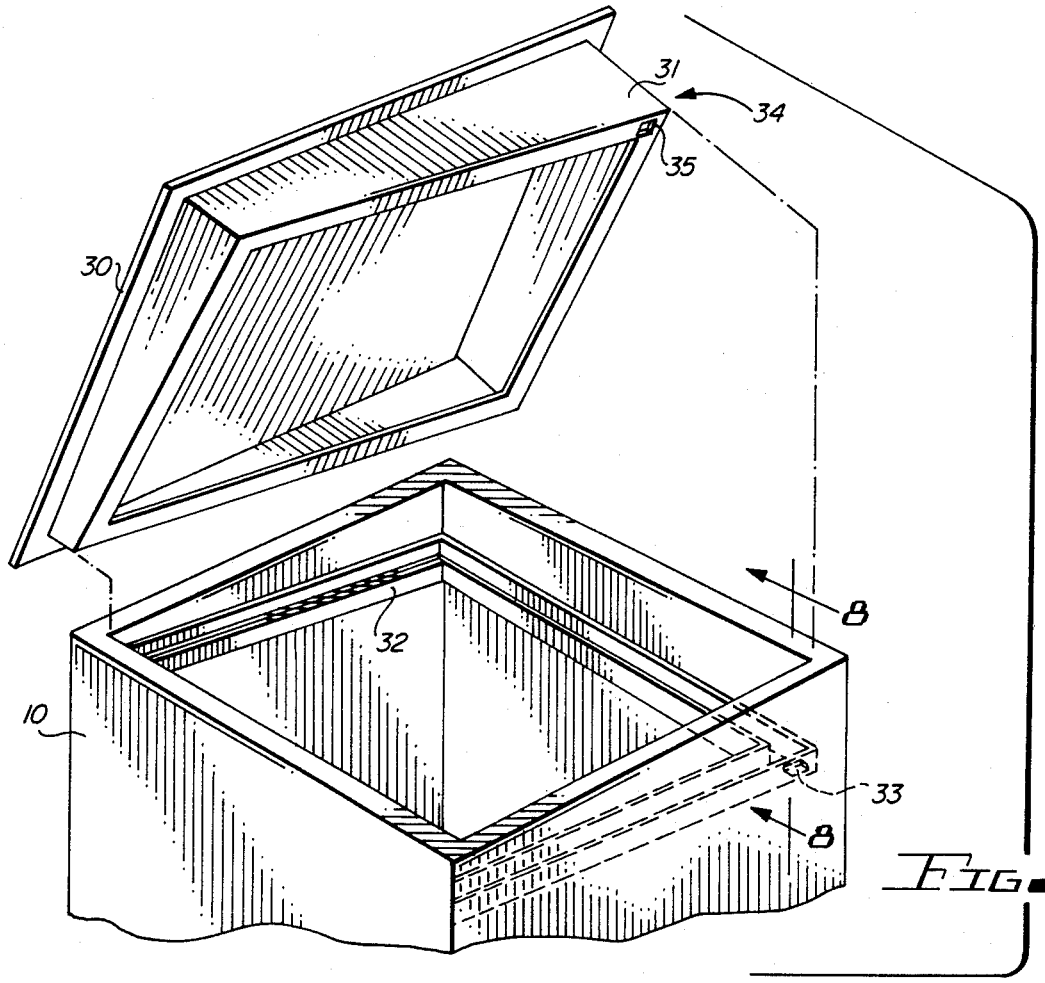
FIG. 7 is a perspective view similar to FIG. 1 of a horizontal top-mounted door showing a canted peripheral maze and canted peripheral channel.

The embodiment shown in FIG. 7 illustrates principles similar to those of FIGS. 1 through 7, as applied to horizontal top-door 30. Door periphery maze 31 is canted toward one corner 34 of top-door 30. Peripheral channel 32 is similarly canted inducing gravity drainage of impinging spray or liquid-residue through drain holes 35 and 33 when maze 31 is mated with peripheral channel 30 as shown in FIG. 8. Deflection lips serving a function comparable to lip 23 of FIGS. 1 and 2 may be employed.

The principle underlying the spray channeling door seal herein described is based upon the mating of two peripheral structures, the first affixed to an access portal and the second to a door periphery, which in combination form an elongated path between a spray-impinging face and a non-spray-impinging face of the door, along with lateral drainage paths offering less resistance to flow than the elongated maze paths, and hence more likely to divert impinging spray or liquid-residue by gravity to drain holes. The spray channeling door seal does not require intimate contact between surfaces of the door and the portal, nor does it require compressible gaskets; thus opening or closing of the door is accomplished with minimal frictional resistance. Canting of the spray channeling door seal achieves the required gravity-induced drainage flow when applied to horizontal top-doors.

While those skilled in the art will conceive other embodiments of the invention drawn from the teaching herein, it is intended that such other embodiments, so drawn, shall fall within the ambit of protection of the claims appended hereto.

Having described my invention in the foregoing specification and drawings in such full detail that those skilled in the art may readily understand and easily practice the invention, that which I claim is:

1. In a door having a first, spray-impinging face and a second, non-spray-impinging face, a spray-channeling door seal comprising:

a portal periphery channel, said portal periphery channel abutting said spray-impinging face when said door is in closed position; and door periphery maze means releasably coupled to said portal periphery channel for diversion and drainage of impinging spray, said door periphery maze means coupled to said spray-impinging face;

wherein said portal periphery channel comprises:

spray deflection means for deflection of impinging spray away from the periphery of said first spray-impinging face;

peripheral cavity means for coupling said portal periphery channel to said door periphery maze means; and drainage means coupled to said door periphery maze means transverse said door from said second, non-spray-impinging face for draining liquid residue of impinging spray in excess of impinging spray deflected by said spray deflection means.

2. A spray channeling door seal in accord with claim 1 wherein said door periphery maze means comprises:

a peripheral flange adjacent said first spray-impinging face, said peripheral flange having a plurality of faces for lengthening communication distance of liquid residue of impinging spray from said first, spray-impinging face to said second, non-spray-impinging face by forming a maze when releasably coupled with said portal periphery channel.

3. A spray channeling door seal in accord with claim 1, wherein said door periphery maze means provides drainage means transverse said door from said non-spray-impinging face for draining liquid residue of impinging spray away from communication between said first face and said second face.

4. A spray channeling door seal in accord with claim 1, wherein a lip coupled to said first spray-impinging face is provided for diversion away from said spray-channeling door seal of liquid residue of spray impinging upon surfaces of said spray-impinging face of said door other than surfaces of said spray-channeling door seal.

5. In a door having a first, spray-impinging face and a second, non-spray-impinging face, wherein neither said face is vertical, a spray channeling door seal comprising:

a portal periphery channel, said portal periphery channel abutting said spray-impinging face when said door is in closed position; and door periphery maze means releasably coupled to said portal periphery channel for diversion and drainage of impinging spray, said door periphery maze means coupled to said spray-impinging face;

wherein said portal periphery channel comprises:

spray-deflection means for deflection of impinging spray away from the periphery of said first spray-impinging face;

peripheral cavity means for coupling said portal periphery channel to said door periphery maze means; and drainage means coupled to said door periphery maze means transverse said door from said second, non-spray-impinging face for draining liquid residue of impinging spray in excess of impinging spray deflected by said spray deflecting means.

6. A spray channeling door seal in accord with claim 5, wherein drain means is provided adjacent the lowermost intersection between a surface of said portal periphery channel and peripheral cavity means upwardly extending therefrom.

7. A spray channeling door seal in accord with claim 5, wherein said door periphery maze means comprises:

a peripheral flange adjacent said first spray-impinging face, said peripheral flange having a plurality of faces for lengthening communication distance of liquid residue of impinging spray from said first, spray-impinging face to said second, non-spray-impinging face by forming a maze when releasably coupled with said portal periphery channel.

8. A spray channeling door seal in accord with claim 5, wherein a lip coupled to said first spray-impinging face is provided for diversion away from said spray-channeling door seal of liquid residue of spray impinging upon surfaces of said spray-impinging face of said door other than surfaces of said spray-channeling door seal.

9. A spray channeling door seal in accord with claim 5, wherein said door periphery maze means provides drainage means transverse said door from said non-spray-impinging face for draining liquid residue of impinging spray away from communication between said first face and said second face.

10. A spray channeling door seal in accord with claim 9, wherein the lowermost surface of said portal periphery channel is canted away from the non-spray-impinging face of said door, for the diversion of spray residue away from said non-spray-impinging face and toward said drainage means.

11. In a door having a first, spray-impinging face and a second, non-spray-impinging face, wherein said spray-impinging face is, when closed, disposed in a substantially horizontal plane, a spray-channeling door seal comprising:

a portal periphery channel, said portal periphery channel abutting said spray-impinging face when said door is in closed position; and door periphery maze means releasably coupled to said portal periphery channel for diversion and drainage of impinging spray, said door periphery maze means coupled to said spray impinging face;

wherein said portal periphery comprises:

spray deflection means for deflection of impinging spray away from the periphery of said first spray impinging face;

peripheral cavity means for coupling said portal periphery channel to said door periphery maze means, wherein said peripheral cavity means is downwardly canted for the gravity disposition of liquid residue of impinging spray; and drainage means coupled to said canted peripheral cavity means transverse said door from said second, non-spray-impinging face for draining liquid residue of impinging spray in excess of impinging spray deflected by said spray deflection means, said drainage means adjacent the lowermost surface of said canted peripheral cavity means.

12. A spray channeling door seal in accord with claim 11, wherein said door periphery maze means comprises:

a peripheral flange adjacent said first spray-impinging face, said peripheral flange having a plurality of faces for lengthening communication distance of liquid residue of impinging spray from said first, spray-impinging face to said second, non-spray-impinging face by forming a maze when releasably coupled with said portal periphery channel, wherein said door periphery maze means is canted for the gravity disposition of liquid residue of impinging spray.

13. A spray channeling door seal in accord with claim 11, wherein said door periphery maze means provides drainage means transverse said door from said non-spray-impinging face for draining liquid residue of impinging spray away from communication between said first face and said second face, said drainage means adjacent the lowermost surface of said door periphery maze means.

14. A spray channeling door seal in accord with claim 11, wherein a plurality of lips coupled to said first spray-impinging face are provided for diversion of liquid residue of spray impinging upon surfaces of said spray-impinging face of said door other than surfaces of said spray channeling door seal away from said spray channeling door seal.

* * * * *